US011040435B2

(12) United States Patent
Liu

(10) Patent No.: US 11,040,435 B2
(45) Date of Patent: Jun. 22, 2021

(54) HEX WRENCH IMPROVED STRUCTURE

(71) Applicant: CHEWREN INDUSTRY CO., LTD., Taichung (TW)

(72) Inventor: Hsi-De Liu, Taichung (TW)

(73) Assignee: CHEWREN INDUSTRY CO., LTD., Taichung (TW)

( * ) Notice: Subject to any disclaimer, the term of this patent is extended or adjusted under 35 U.S.C. 154(b) by 321 days.

(21) Appl. No.: 16/352,820

(22) Filed: Mar. 14, 2019

(65) Prior Publication Data

US 2020/0290181 A1 Sep. 17, 2020

(51) Int. Cl.
*B25B 15/00* (2006.01)

(52) U.S. Cl.
CPC ..... *B25B 15/008* (2013.01)

(58) Field of Classification Search
CPC ..... B25B 15/005; B25B 15/008
See application file for complete search history.

(56) References Cited

U.S. PATENT DOCUMENTS 10,385,902 B2 * 8/2019 Wunderlich ..... B25B 15/008
2019/0186526 A1 * 6/2019 Dilling ..... B25B 15/005

* cited by examiner

*Primary Examiner* — David B. Thomas
(74) *Attorney, Agent, or Firm* — Bruce Stone LLP; Joseph A. Bruce

(57) ABSTRACT

A hex wrench improved structure comprises a body, one end thereof has six equally divided planes, an abutting angle is formed between each of the two planes, at least one of the planes is disposed with a groove, the groove has two inclined surfaces, one side of each of the two inclined surfaces is connected to the abutting angle of the two planes, another sides of the two inclined surfaces are connected to each other, and an obtuse angle is included between the two inclined surfaces; thereby, the hex wrench can be pressed tightly against an inner wall surface of a hole in a screw for inserting a cap screw tool to apply force, so that the hex wrench is not easy to slip, and it is easier to turn and lock or adjust the screw.

5 Claims, 4 Drawing Sheets

HEX WRENCH IMPROVED STRUCTURE

BACKGROUND OF THE INVENTION

Field of Invention

The present invention relates to the technical field of hand tools, and more particularly to a hex wrench improved structure.

Related Art

The conventional hex wrench has a working end, and the working end has a rod shape and is provided with six equally divided planes, positions where the six planes are connected have angular edges respectively, and each of the angular edges is provided with a groove; thereby, the inner surface of an accommodating groove of a cap screw after being interlocked and worn by the angular edges can achieve objects of being tightly pressed to apply force, not easy to slip, and with better efficiency of application of force.

However, the hex wrench disclosed in the aforementioned patent has an acute angle of angular edge that is too small, so it has defects of being easily collapsed and cannot withstand excessive torque.

In view of this, it is necessary to improve the defects of the aforementioned conventional hex wrench, in response to the aforementioned defects, and based on many years of experience in engaging in the manufacturing, development and design of related products, the inventor has finally obtained a hex wrench improved structure of the present invention through design and development.

SUMMARY OF THE INVENTION

An object of the present invention is to solve the defect that the acute angle of angular edge of the hex wrench with the recessed groove is too small, thereby preventing the hex wrench from collapsing.

In order to achieve the foregoing object, the present invention is a hex wrench improved structure, comprising:

a body, one end thereof has six equally divided planes, an abutting angle is formed between each of the two planes, at least one of the planes is disposed with a groove, the groove has two inclined surfaces, one side of each of the two inclined surfaces is connected to the abutting angle of the two planes, another sides of the two inclined surfaces are connected to each other, and an obtuse angle is included between the two inclined surfaces.

In one preferred embodiment, the obtuse angle is between 100 degrees and 130 degrees.

In one preferred embodiment, a bottom surface is included between the two inclined surfaces, the two inclined surfaces extend and an angle included after intersection is the obtuse angle.

In one preferred embodiment, another end of the body opposite to the groove is spherical, and is disposed with six equally divided abutting surfaces, an engage angle is formed between each of the two abutting surfaces, an included angle is included between each of the two abutting surfaces, and the included angle is greater than a right angle and is an obtuse angle.

In one preferred embodiment, the engage angle is between 100 degrees and 130 degrees.

Thereby, the hex wrench can be pressed tightly against an inner wall surface of a hole in a screw for inserting a cap screw tool to apply force, so that the hex wrench is not easy to slip, and it is easier to turn and lock or adjust the screw, and it does not have an acute angle, making it difficult to be damaged as a whole and more durable.

DETAILED DESCRIPTION OF THE INVENTION

The foregoing and other technical contents, features and effects of the present invention to achieve the above object will be clearly presented in the following detailed description of the preferred embodiments with reference to the drawings.

Figure 1:
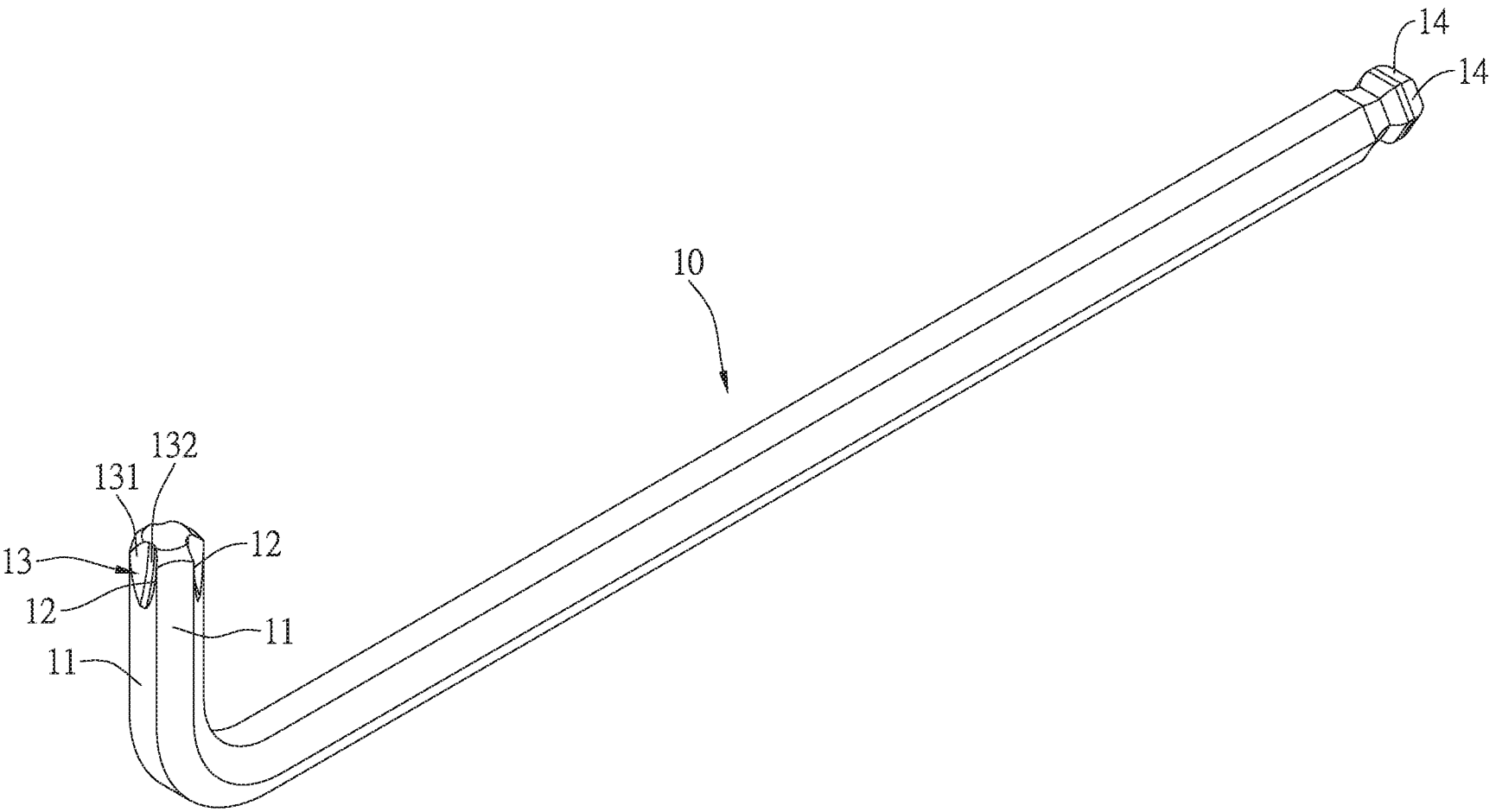
FIG. 1 is a perspective view of a preferred embodiment of the present invention.
Figure 2:
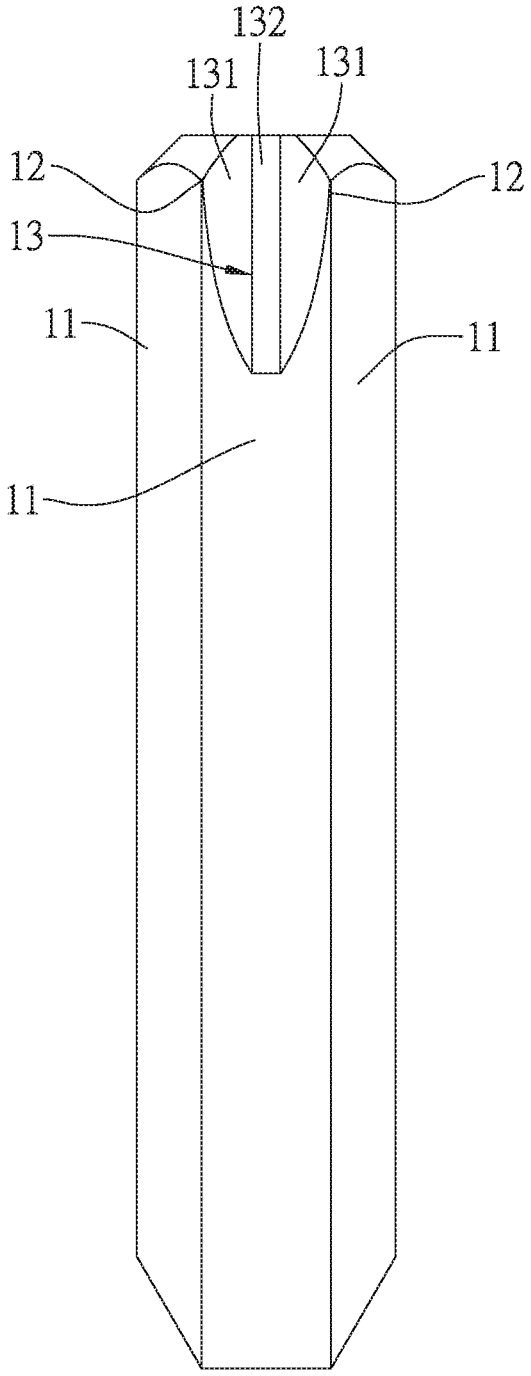
FIG. 2 is a side view of a preferred embodiment of the present invention.
Figure 3:
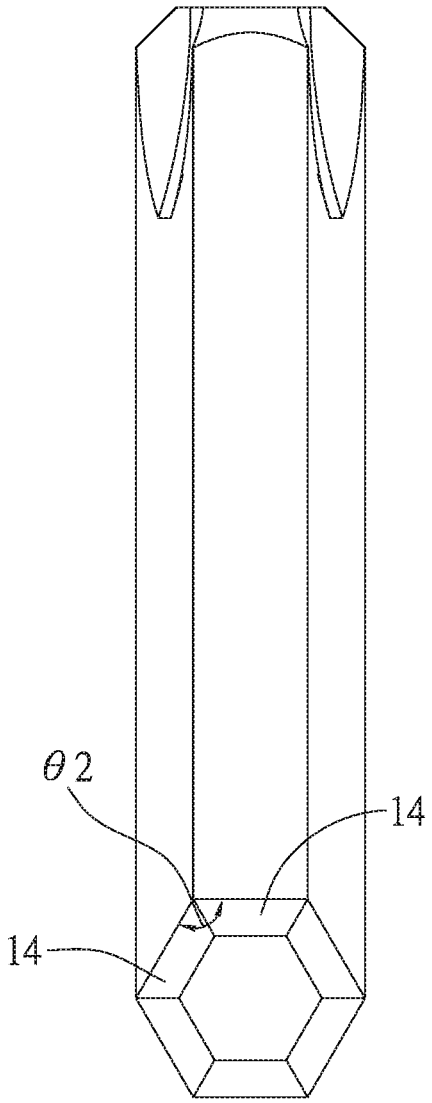
FIG. 3 is a partial enlarged view of one end of a preferred embodiment of the present invention.
Figure 4:
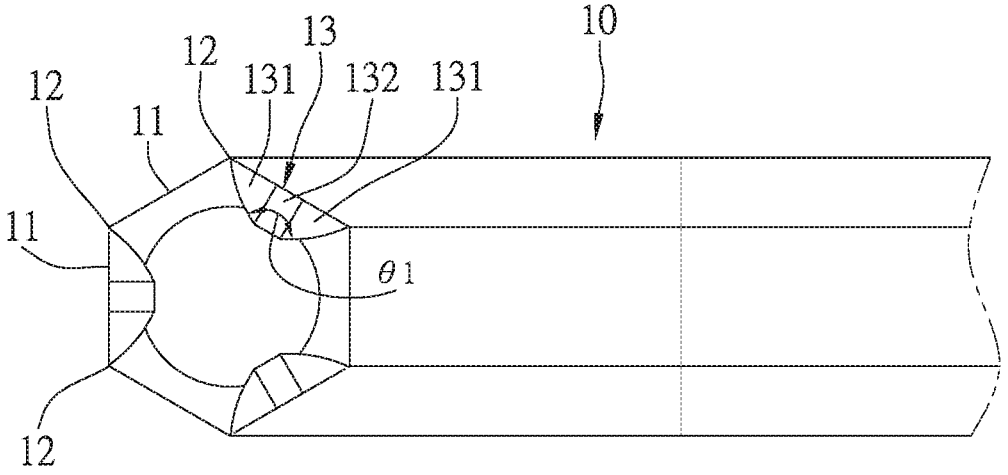
FIG. 4 is a partial enlarged view of another end of a preferred embodiment of the present invention.

Referring to FIG. 1 to FIG. 4, the present invention is a hex wrench improved structure, comprising:

a body 10, one end thereof has six equally divided planes 11, an abutting angle 12 is formed between each of the two planes 11, at least one of the planes 11 is disposed with a groove 13, the groove 13 has two inclined surfaces 131, one side of each of the two inclined surfaces 131 is connected to the abutting angle 12 of the two planes 11, another sides of the two inclined surfaces 131 are connected to each other, and an obtuse angle θ1 is included between the two inclined surfaces 131; thereby, the hex wrench can be pressed tightly against an inner wall surface of an inner hexagonal hole in a screw to apply force, so that the hex wrench is not easy to strip, and it is easier to turn and lock or adjust the screw tightness, and the hex wrench does not have structures of acute angle, making it difficult to collapse and more durable.

In the hex wrench improved structure, wherein the obtuse angle θ1 is between 100 degrees and 130 degrees.

In the hex wrench improved structure, wherein a bottom surface 132 is included between the two inclined surfaces 131, the two inclined surfaces 131 extend and an angle included after intersection is the obtuse angle θ1.

Another end of the body 10 opposite to the groove 13 is spherical, and is disposed with six equally divided abutting surfaces 14, an engage angle θ2 is formed between each of the two abutting surfaces 14, an included angle is included between each of the two abutting surfaces 14, and the included angle is greater than a right angle and is an obtuse angle. Thereby, the hex wrench can be pressed tightly against an inner wall surface of a hole in a screw for inserting a cap screw tool to apply force, so that the hex wrench is not easy to slip, and it is easier to turn and lock or adjust the screw, and it does not have an acute angle, making it difficult to be damaged as a whole and more durable.

In the hex wrench improved structure, wherein the engage angle θ2 is between 100 degrees and 130 degrees.

It can be known from the above that, the hex wrench of the present invention has not been disclosed and is indeed novel, and its features are not those that can be easily combined and accomplished by those having ordinary skill in the art, and thus are more in line with the requirements of non-obviousness. The grooves 13 formed on the six planes 11 can achieve the efficacies of not easy to slip when force is applied in turning, as well as easy to turn and lock or adjust the screw tightness, and it does not have an acute angle, so that the overall structure is robust, not easy to collapse and durable.

The foregoing description of the preferred embodiments is a detailed description of the technical features of the present invention, however, those of ordinary skill in the art can of course change and modify the present invention without departing from the spirit and principles of the present invention. Simple modifications or alterations may be made without departing from the scope defined by the appended claims of the present invention.

In summary, the hex wrench provided by the present invention has indeed achieved the objects of the present invention. The combination structure is not found in the same type of products, nor has it been disclosed before the application, and therefore the application is submitted in accordance with the provisions of the Patent Law.

What is claimed is:

1. A hex wrench improved structure, comprising:

a body, one end thereof having six equally divided planes, an abutting angle being formed between each of the two planes, at least one of the planes being disposed with a groove, the groove having two inclined surfaces, one side of each of the two inclined surfaces being connected to the abutting angle of the two planes, another sides of the two inclined surfaces being connected to each other, and an obtuse angle being included between the two inclined surfaces.

2. The hex wrench improved structure as claimed in claim 1, wherein the obtuse angle is between 100 degrees and 130 degrees.

3. The hex wrench improved structure as claimed in claim 1, wherein a bottom surface is included between the two inclined surfaces, the two inclined surfaces extend and an angle included after intersection is the obtuse angle.

4. The hex wrench improved structure as claimed in claim 1, wherein another end of the body opposite to the groove is spherical, and is disposed with six equally divided abutting surfaces, an engage angle is formed between each of the two abutting surfaces, an included angle is included between each of the two abutting surfaces, and the included angle is greater than a right angle and is an obtuse angle.

5. The hex wrench improved structure as claimed in claim 4, wherein the engage angle is between 100 degrees and 130 degrees.

* * * * *